US006979302B2

(12) United States Patent
Chen

(10) Patent No.: US 6,979,302 B2
(45) Date of Patent: Dec. 27, 2005

(54) FAT-REMOVAL MASSAGER

(76) Inventor: Jung-Tsung Chen, No.5, Alley 10, Lane 256, Hai Wei Rd., Long Jing Hsiang, Taichung (TW) 434

( * ) Notice: Subject to any disclaimer, the term of this patent is extended or adjusted under 35 U.S.C. 154(b) by 339 days.

(21) Appl. No.: 10/361,187

(22) Filed: Feb. 10, 2003

(65) Prior Publication Data

US 2004/0158179 A1 Aug. 12, 2004

(51) Int. Cl.[7] ..... A61H 7/00

(52) U.S. Cl. ..... 601/87; 601/112; 601/133; 601/134

(58) Field of Search ..... 601/84, 85, 87, 601/94, 95, 103, 112, 113, 114, 133, 134, 601/135, 136, 137

(56) References Cited

U.S. PATENT DOCUMENTS

| | | | | |
|---|---|---|---|---|
| 1,777,151 | A * | 9/1930 | Ruttger-Pelli | 601/113 |
| 3,499,439 | A * | 3/1970 | Boller | 601/95 |
| 4,526,163 | A * | 7/1985 | Fedders | 601/112 |
| 5,103,809 | A * | 4/1992 | DeLuca et al. | 601/135 |
| 2004/0106882 | A1 * | 6/2004 | Tseng | 601/86 |

* cited by examiner

*Primary Examiner*—Danton D. DeMille
*Assistant Examiner*—Quang D. Thanh
(74) *Attorney, Agent, or Firm*—Troxell Law Office, PLLC; Kuo-Hsiung Chiu

(57) ABSTRACT

The present invention relates to a fat-removal massager utilizing a speed-adjustable motor in combination with two corresponding gear sets for driving a plurality of eccentrically rotatable massaging balls. Moreover, every two neighboring massaging balls in rotation create a rapid squeezing effect upon muscles for achieving the expected fat-removing and massaging goal.

4 Claims, 2 Drawing Sheets

A–A

FAT-REMOVAL MASSAGER

BACKGROUND OF THE INVENTION

1. Field of the Invention

The present invention relates to a new and improved fat-removal massager, and more particularly, to an apparatus which can be used everywhere and held by a single hand to achieve the massaging and fat-removing effect.

2. Description of the Prior Art

The commercially available massagers work in the vibrating or in-place striking way. The vibrating massager makes use of the rapid vibration to achieve the relaxing and vibrating effect upon the local muscles. The in-place striking massager exerts a certain pressure on the local point (acupuncture point) of muscles to achieve the effect of relaxing muscles and nerves.

The above-mentioned massagers can create relaxing effect on the local muscles. However, they can't produce squeezing and fat-removing effect upon the muscles containing much fat. Thus, it's necessary to improve them.

SUMMARY OF THE INVENTION

It is a primary object of the present invention to eliminate the above-mentioned drawbacks and to provide a fat-removal massager which utilizes a speed-adjustable motor in combination with two corresponding gear sets for driving a plurality of eccentrically rotatable massaging balls. Moreover, every two neighboring massaging balls in rotation create a rapid squeezing effect upon muscles for achieving the expected fat-removing and massaging goal.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
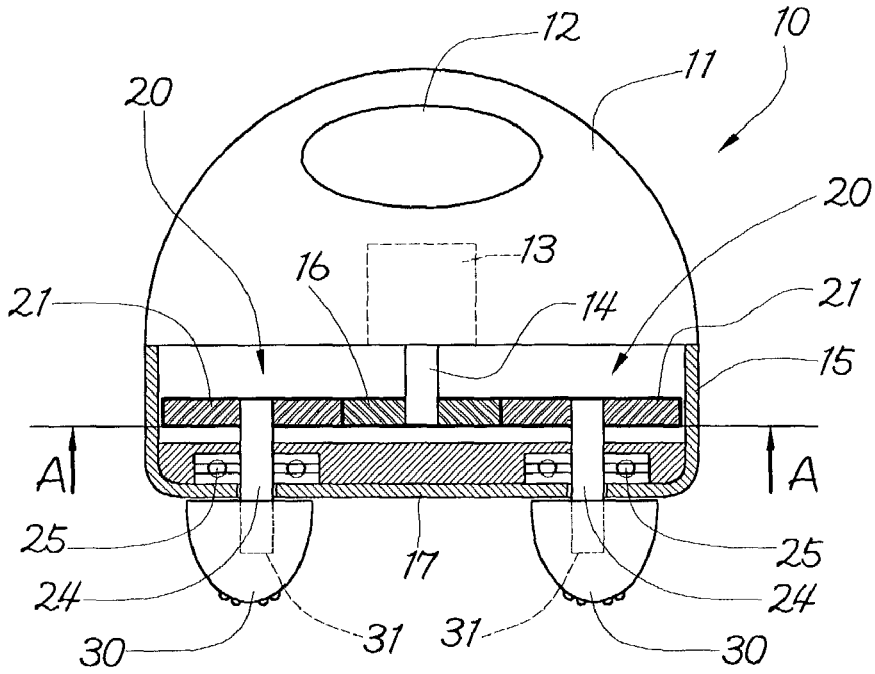
FIG. 1 is a local section of a preferred embodiment of the present invention.
Figure 2:
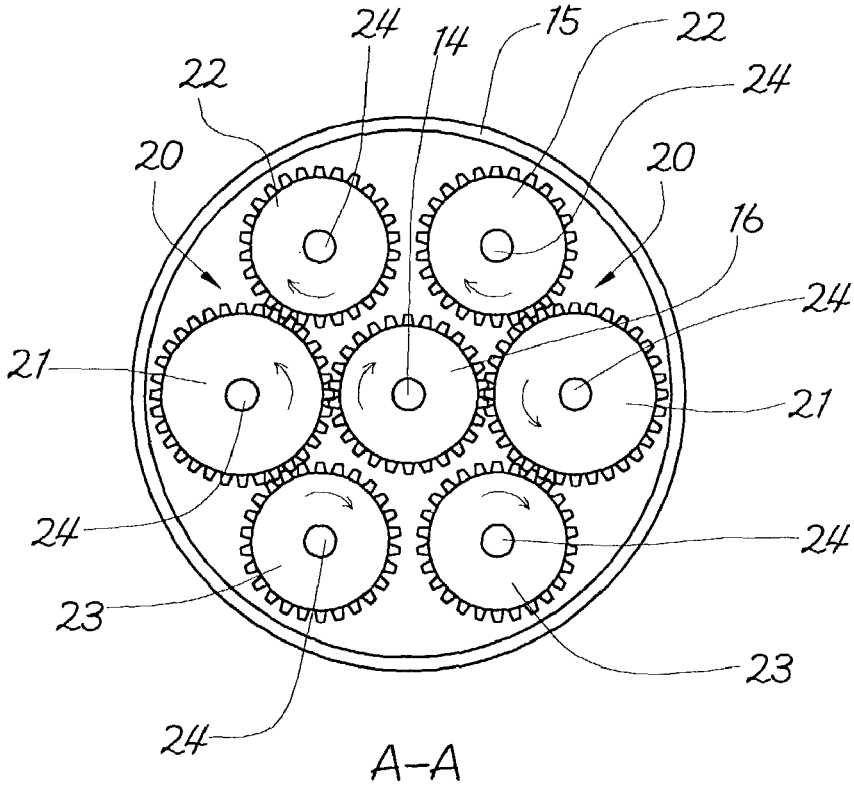
FIG. 2 is a sectional view taken along the line A—A of the preferred embodiment in FIG. 1.

First of all, referring to FIGS. 1 and 2, a preferred embodiment of the present invention is shown. The present invention includes:

- a main body 10 having a handle portion 12 at the upper section 11 thereof and a speed-adjustable motor 13 within the main body, the speed-adjustable motor 13 having a shaft 14 extending downwards into the inside of the lower section 15 of the main body 10 for bringing a primary transmission gear 16 in motion;
- two pairs of gear sets 20 positioned within the lower section 15 of the main body 10 and arranged around the primary transmission gear 16 to form a circle, each of the gear sets 20 having a secondary transmission gear 21 and two driven gears 22, 23, each of the gears 21, 22, 23 being coupled with a massaging ball 30 by means of an axle 24 and a bearing 25, each of the massaging balls 30 being protruding outside a bottom cover 17 of the lower section 15 of the main body 10 after assembly, each of the massaging balls 30 being coupled with the axle 24 through an eccentric hole 31.

Figure 3:
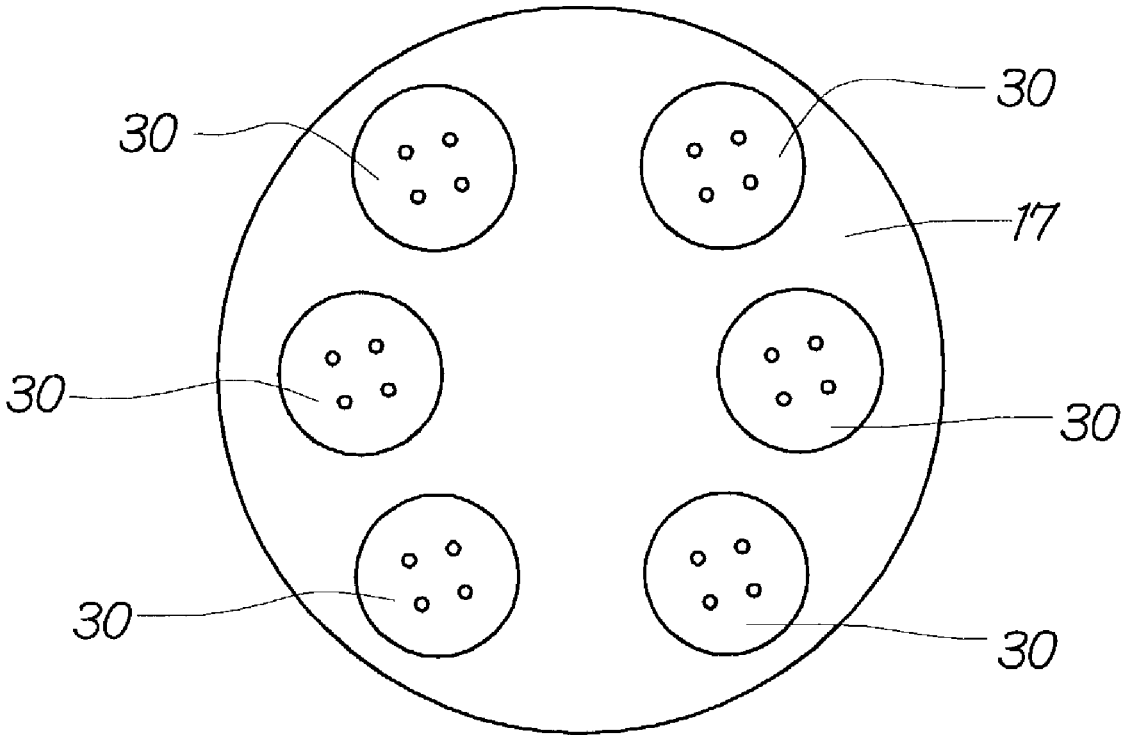
FIG. 3 is a bottom view of the preferred embodiment in FIG. 1.

Based upon the assembly of the aforementioned components, when the motor 13 is actuated to bring the primary transmission gear 16 in rotation, the secondary transmission gears 21 at both sides of the primary transmission gear 16 are also rotated. Therefore, both driven gears 22, 23 are rotated with the secondary transmission gear 21. As illustrated in FIGS. 2 and 3, every two neighbored massaging balls 30 create an inwardly pressing movement due to the opposite rotational state. Thus, when the present invention is placed upon the waist, the abdomen, etc. every two neighbored massaging balls 30 produce a proper pressing effect on the local muscle, thereby achieving the fat-removing effect.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A fat-removal massager comprising:

a) a main body having:
   i) a handle portion located in an upper section thereof;
   ii) a speed-adjustable motor having a shaft extending downwardly into a lower section; and
   iii) a primary transmission gear located in the lower section and connected to the shaft;

b) six massaging balls located below the lower section;

c) two gear sets located in the lower section forming a circle around the primary transmission gear, each of the two gear sets having:
   i) two driven gears; and
   ii) a secondary transmission gear engaging the primary transmission gear and each of the two driven gears, the secondary transmission gear being driven by the primary transmission gear and driving each of the two driven gears; and d) six axles, each of the six axles is connected at a first axle end to one of the two driven gears and the secondary transmission gear and at a second axle end to an eccentric hole in one massaging ball of the six massaging balls.

2. The fat-removal massager according to claim 1, further comprising six bearings, one of the six bearings is located around a middle section of each of the six axles.

3. The fat-removal massager according to claim 1, wherein one of four massaging balls of the six massaging balls is connected to each of the two driven gears of each of the two gear sets, one of two massaging balls of the six massaging balls is connected to each secondary transmission gear of each of the two gear sets, the shaft and the four massaging balls rotating in a first direction, and the two massaging balls rotating in a second direction opposite the first direction.

4. The fat-removal massager according to claim 1, wherein two adjacent massaging balls of the six massaging balls providing a squeezing effect.

* * * * *